US012539897B2

(12) United States Patent
Sunde et al.

(10) Patent No.: US 12,539,897 B2
(45) Date of Patent: Feb. 3, 2026

(54) YOKE-MOUNTED COUPLER SUPPORT

(71) Applicant: Strato Technology Solutions, LLC, Saginaw, TX (US)

(72) Inventors: Jonathan Sunde, Fort Worth, TX (US); Michael Ring, Lake Village, IN (US)

(73) Assignee: Strato Technology Solutions, LLC, Saginaw, TX (US)

( * ) Notice: Subject to any disclaimer, the term of this patent is extended or adjusted under 35 U.S.C. 154(b) by 1004 days.

(21) Appl. No.: 17/619,805

(22) PCT Filed: Apr. 10, 2020

(86) PCT No.: PCT/US2020/027645
§ 371 (c)(1),
(2) Date: Dec. 16, 2021

(87) PCT Pub. No.: WO2020/256812
PCT Pub. Date: Dec. 24, 2020

(65) Prior Publication Data

US 2022/0315069 A1 Oct. 6, 2022

Related U.S. Application Data

(63) Continuation of application No. 16/445,364, filed on Jun. 19, 2019, now abandoned.

(51) Int. Cl.

| | |
|---|---|
| ***B61G 9/22*** | (2006.01) |
| ***B61G 9/06*** | (2006.01) |
| ***B61G 9/10*** | (2006.01) |
| ***B61G 9/24*** | (2006.01) |

(52) U.S. Cl.
CPC ..... *B61G 9/22* (2013.01); *B61G 9/06* (2013.01); *B61G 9/10* (2013.01); *B61G 9/24* (2013.01)

(58) Field of Classification Search
CPC . B61G 9/06; B61G 9/04; B61G 9/045; B61G 9/10; B61G 9/08; B61G 9/12; B61G 9/20; B61G 9/24; B61G 9/22
See application file for complete search history.

(56) References Cited

U.S. PATENT DOCUMENTS 1,282,943 A * 10/1918 Priebe ..... B61G 9/10 213/27
1,492,779 A * 5/1924 Cook ..... B61G 9/10 213/26

(Continued)

FOREIGN PATENT DOCUMENTS

GB 919899 2/1963

OTHER PUBLICATIONS

Feb. 14, 2020, PCT International Search Report of Corresponding PCT Application No. PCT/US2019/066441, of Record in U.S. Appl. No. 16/206,097.

(Continued)

*Primary Examiner* — Cheng Lin
(74) *Attorney, Agent, or Firm* — AP Patents; Alexander Pokot

(57) ABSTRACT

A yoke for a railway car is provided with a coupler support protruding from a top wall of the yoke into an interior space in the yoke to contact the coupler shank when the coupler head is deflected downward to prevent the coupler from drooping after prolonged use.

26 Claims, 6 Drawing Sheets

(56) References Cited

U.S. PATENT DOCUMENTS

| | | | | | |
|---|---|---|---|---|---|
| 1,659,458 | A * | 2/1928 | Clark | B61G 9/24 | 213/67 R |
| 1,871,427 | A * | 8/1932 | Schulz | B61G 9/24 | 213/67 R |
| 2,054,251 | A | 9/1936 | Haseltine | | |
| 2,469,126 | A | 5/1949 | Munro et al. | | |
| 2,559,743 | A | 7/1951 | Williams | | |
| 2,706,050 | A | 4/1955 | Sprouse | | |
| 2,728,465 | A | 12/1955 | Campbell | | |
| 2,738,078 | A * | 3/1956 | Tucker | B61G 9/06 | 213/45 |
| 2,766,894 | A | 10/1956 | Campbell | | |
| 2,825,472 | A | 3/1958 | Peterson | | |
| 2,970,703 | A | 2/1961 | Blattner | | |
| 3,034,662 | A * | 5/1962 | Willison | B61G 9/10 | 213/34 |
| 3,197,037 | A | 7/1965 | Willison | | |
| 3,370,718 | A | 2/1968 | Waddell | | |
| 3,622,015 | A | 11/1971 | Atkinson et al. | | |
| 3,682,324 | A * | 8/1972 | Hawthorne | B61G 9/04 | 213/69 |
| 3,712,479 | A | 1/1973 | Atkinson | | |
| 3,788,493 | A * | 1/1974 | Hawthorne | B61G 7/06 | 213/67 R |
| 3,800,961 | A | 4/1974 | Hawthorne | | |
| 3,827,575 | A | 8/1974 | Mosier et al. | | |
| 3,838,778 | A | 10/1974 | Appleton | | |
| 4,776,474 | A * | 10/1988 | Terlecky | B61G 9/12 | 213/50 |
| 5,312,007 | A | 5/1994 | Kaufhold et al. | | |
| 5,443,170 | A | 8/1995 | Merker, Jr. et al. | | |
| 5,487,480 | A | 1/1996 | Page et al. | | |
| 6,446,820 | B1 | 9/2002 | Barker et al. | | |
| 6,681,943 | B2 * | 1/2004 | Barker | B61G 9/06 | 213/46 R |
| 7,766,177 | B2 * | 8/2010 | Stepp | B61G 9/22 | 213/7 |
| 8,590,717 | B2 | 11/2013 | Wilt et al. | | |
| 8,870,002 | B2 | 10/2014 | Wilt et al. | | |
| 8,939,300 | B2 | 1/2015 | Wilt et al. | | |
| 8,985,355 | B2 | 3/2015 | Wilt | | |
| 9,056,618 | B2 | 6/2015 | Gagliardino et al. | | |
| 9,598,092 | B2 | 3/2017 | James et al. | | |
| 9,669,848 | B2 | 6/2017 | Creighton et al. | | |
| 9,789,888 | B2 | 10/2017 | Wilt et al. | | |
| 9,868,453 | B2 * | 1/2018 | Johnson | B61G 11/02 | |
| 10,011,288 | B2 | 7/2018 | Gagliardino et al. | | |
| 10,086,852 | B2 | 10/2018 | Iler | | |
| 10,308,263 | B1 * | 6/2019 | Ring | B61G 9/10 | |
| 10,513,042 | B2 | 12/2019 | Ring et al. | | |
| 11,117,600 | B2 * | 9/2021 | Sunde | B61G 9/20 | |
| 2002/0070189 | A1 | 6/2002 | Barker et al. | | |
| 2006/0043044 | A1 | 3/2006 | Ring et al. | | |
| 2008/0008225 | A1 | 1/2008 | Ahmad et al. | | |
| 2008/0011700 | A1 * | 1/2008 | Brough | B61G 9/24 | 213/75 R |
| 2013/0270210 | A1 | 10/2013 | Kukulski et al. | | |
| 2015/0251671 | A1 | 9/2015 | Iler | | |
| 2015/0307115 | A1 | 10/2015 | Wang et al. | | |
| 2017/0080956 | A1 | 3/2017 | James et al. | | |
| 2017/0166225 | A1 * | 6/2017 | Schoedl | B61G 9/04 | |
| 2017/0210398 | A1 | 7/2017 | Wilt et al. | | |
| 2017/0334469 | A1 | 11/2017 | Johnson et al. | | |
| 2018/0118235 | A1 | 5/2018 | Johnson et al. | | |
| 2019/0144014 | A1 | 5/2019 | Strato | | |
| 2019/0144015 | A1 | 5/2019 | Ring et al. | | |

OTHER PUBLICATIONS

Feb. 14, 2020, PCT Written Opinion of Corresponding PCT Application No. PCT/US2019/066441, of Record in U.S. Appl. No. 16/206,097.

Feb. 18, 2020, PCT International Search Report of Corresponding PCT Application No. PCT/US19/63837, of Record in U.S. Appl. No. 16/774,290.

Feb. 18, 2020, PCT Written Opinion of Corresponding PCT Application No. PCT/US19/63837, of Record in U.S. Appl. No. 16/774,290.

Jun. 19, 2020, PCT International Search Report for Application No. PCT/US2020/027645, of Record in U.S. Appl. No. 16/445,364.

* cited by examiner

YOKE-MOUNTED COUPLER SUPPORT

BACKGROUND OF THE INVENTION

Railway cars in a train are connected to an adjacent car by a coupler. The coupler is joined to a yoke and the assembly is mounted in a railway car center sill. In "cushioned" railway cars, to prevent damage to the railway cars and the laded goods during operation, and during assembly of the railway car train in the yard, various devices have been installed to absorb loads on the coupler so that impact forces transmitted to the railway car are reduced. These cushioning devices include draft gear, hydraulic (EOCC) units, and "selective cushioning units" as described below.

The coupler extends from the yoke at the end of the railway car and may be subject to "droop," which occurs when the coupler head deflects downward due to gravity and normal usage. Excessive droop may cause alignment problems when couplers of adjacent cars are connected, as well as other misalignments of various pieces of equipment attached to the coupler.

In an "E-type" yoke, the coupler is attached to the yoke with a draft key, and vertical forces on the draft key may cause the key to crack and deform, which can cause costly repair.

The inventors herein have studied the problems posed by vertical forces on the coupler in a variety of yoke-coupler environments and configurations to develop solutions to these problems, including problems posed by coupler droop.

SUMMARY OF THE INVENTION

Thus, an object of the invention is to configure E-Type yokes in a variety of environments to prevent coupler droop. Another object is to provide methods for modifying a yoke to prevent coupler droop.

In one aspect, the invention is a yoke for a railway car, comprising: an open front end adapted to receive a coupler shank, a vertical tail wall opposite the front end, a top wall and a bottom wall opposite the top wall, a first side wall connecting the top wall and the bottom wall, and a second side wall opposite the first side wall, the first and second side walls each having an aligned key slot toward the front end of the yoke adapted to receive a coupler key laterally, the top and bottom wall each having an interior surface adapted to face the coupler shank and defining an interior space in the yoke; and a coupler support extending from the top wall into the interior space of the yoke adapted to contact the coupler shank and prevent downward deflection of the coupler.

In the context of an end of car cushioning (EOCC) unit wherein an E-type yoke engages a hydraulic unit, the coupler support feature of the present invention may provide support from the top wall of the yoke in addition to a support feature on the bottom wall of the yoke supporting the coupler shank from below.

In this aspect, an end-of-car cushioning apparatus according to the invention comprises the yoke as described above, a coupler shank received in the front end of the yoke abutting the vertical rear (or "tail") wall of the yoke, a coupler support extending from the top wall into the interior space of the yoke adapted to contact the coupler shank and reduce downward deflection of the coupler, and a hydraulic unit positioned behind the vertical rear wall of the yoke, comprising a piston received in a recess of the yoke behind the vertical rear wall of the yoke and a cylinder filled with a fluid and receiving the piston, wherein the fluid is adapted to dissipate forces when the piston moves in the cylinder in response to loads on the coupler.

In other embodiments, a yoke equipped with a coupler support may be configured to accommodate "selective cushioning apparatuses" such as disclosed in U.S. Pat. Nos. 10,308,283, 10,513,275, and in U.S. pending application Ser. No. 16/206,097, filed Nov. 30, 2018, and No. U.S. Ser. No. 16/250,267, filed Jan. 17, 2019, all of which are by the inventors herein and are incorporated herein by reference in their entirety. In some of these apparatuses, a stack of elastomeric units may be positioned inside a specially configured yoke, cushioning buff and draft loads on the coupler, and a stack of elastomeric units may be positioned in the sill behind the yoke to cushion buff loads on the coupler. In combination, these systems may yield cushioning performance as good or better than a hydraulic cushioning unit, without the drawbacks of a hydraulic cylinder.

For example, an end-of-car cushioning apparatus for a railway car according to the invention may comprise: an E-Type yoke adapted to receive a coupler shank, substantially as described above, a coupler follower received in the yoke behind the coupler shank adapted to move inside the yoke in response to draft and buff loads on the coupler, and a first stack of elastomeric units positioned between the coupler follower and the vertical rear wall of the yoke compressed in response to buff and draft loads on the coupler. The yoke is provided with a coupler support protruding from the interior surface of the top wall in front of the coupler follower contacting the coupler shank when the end of the coupler extending from the railway car is subjected to downward forces. In embodiments, the center of gravity of the yoke and coupler combination is positioned inboard of the end of the car, which reduces vertical forces on the draft key.

Coupler support may also be provided on a standard E-Type draft gear configuration. In this aspect, a yoke is provided having an open front end adapted to receive a coupler shank, a vertical tail wall opposite the front end, a top wall and a bottom wall opposite the top wall, a first side wall connecting the top wall and bottom wall, and a second side wall opposite the first side wall. The first and second side walls each have an aligned key slot toward the front end of the yoke adapted to receive a coupler key laterally, and the top and bottom walls each have an interior surface adapted to face the coupler shank defining an interior space in the yoke. A coupler shank is received in the front end of the yoke abutting a coupler follower which is positioned inside the yoke and adapted to move in response to forces on the coupler. A coupler support is provided extending from the top wall into the interior space of the yoke adapted to contact the coupler shank and reduce downward deflection of the front end of the coupler. A frictional draft gear comprising a housing, an elastic element received in the housing, and a piston or friction clutch compressing the elastic element in response to buff and draft loads on the coupler, is provided in the interior space of the yoke.

In embodiments, the apparatus is configured for installation in an EOC-7 or EOC-8 sill pocket and is provided with a coupler support protruding into an interior space of the yoke and engaging the shank to prevent the coupler head from deflecting downward.

BRIEF DESCRIPTION OF THE FIGURES

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
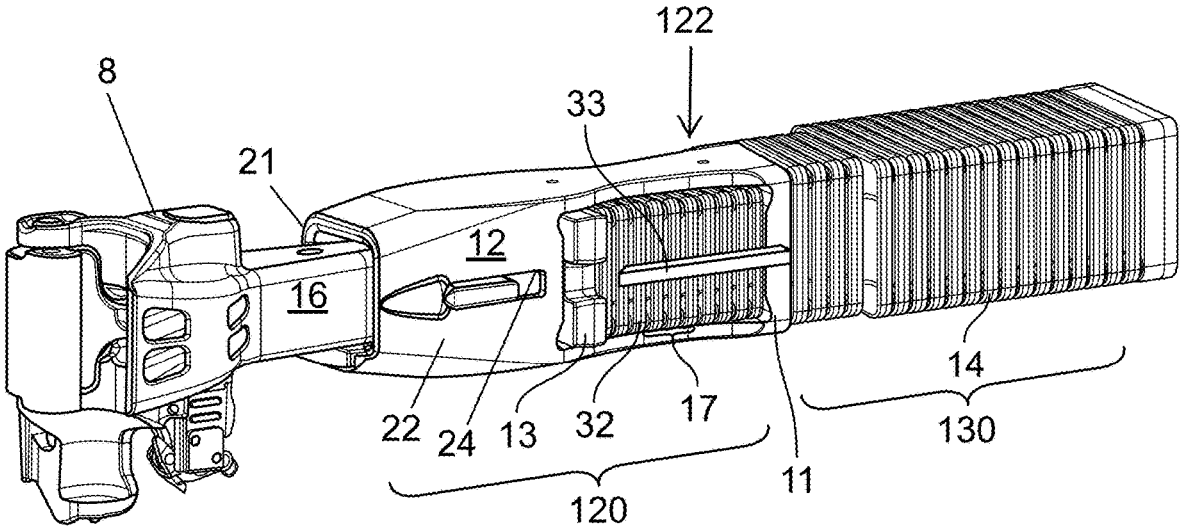
FIG. 1 is a perspective view of a cushioning apparatus according to an embodiment of the invention.

The drawings may not be to scale and features not necessary for an understanding of the invention are not shown.

DETAILED DESCRIPTION OF THE INVENTION

Directions and orientations herein refer to the normal orientation of a railway car in use. Thus, unless the context clearly requires otherwise, the "front" of a coupler is in a direction away from the body of the car and "rear" is in a direction from the front end of the coupler toward the car body. Likewise, the "longitudinal" axis or direction is parallel to the rails and in the direction of movement of the railway car on the track in either direction. The "transverse" or "lateral" axis or direction is in a horizontal plane perpendicular to the longitudinal axis. The term "inboard" means toward the center of the car, and may mean inboard in a longitudinal direction, a lateral direction, or both. Similarly, "outboard" means away from the center of the car. "Vertical" is the up-and-down direction and the "vertical plane" is perpendicular to the longitudinal axis. "Horizontal" is a plane parallel to the surface the train travels on. "Up" and "upward" mean toward the sky and "down" and "downward" mean toward the ground.

As used herein, the term "about" associated with a numerical value is understood to indicate a margin of +/−20% of the value. In embodiments, "about" indicates a range of +/−10% of the stated numerical value. In still other embodiments, "about" indicates a range of +/−5% around the stated numerical value. When used to modify a range of values, "about" indicates +/−20%, +/−10% or +/−5% of the range.

"Droop" is downward deflection of the coupler head with respect to a horizontal orientation.

"Elastomer" and "elastomeric" refer to polymeric materials having elastic properties so that they exert a restoring force when compressed. Examples of such materials include, without limitation, thermoplastic elastomer (TPE), natural and synthetic rubbers such as: neoprene, isoprene, butadiene, styrene-butadiene rubber (SBR), polyurethanes, and derivatives. Thermoplastic copolyesters used in some conventional draft gear may be used in the stacks of elastomeric units according to the invention.

"Travel" refers to a distance traveled by the coupler when the cushioning elements are fully compressed. "Travel" generally refers to the full possible extent of such movement, e.g., when the elastomeric pads in a stack of elastomeric units are compressed and the metal plates of adjacent elastomeric units contact one another. Travel may be draft travel or buff travel, permitted by the draft gear, by the one or more stacks of elastomeric units or by a hydraulic unit, as the case may be.

A person having ordinary skill in the art has a general knowledge of standards and procedures established by the Association of American Railroads ("AAR") and the published AAR standards cited herein are incorporated by reference as background. Reference herein to AAR standards refers to standards in effect on the filing date of this application. In non-limiting embodiments, the selective cushioning apparatus fits between front and rear stops of an "EOC-7" pocket of about 38¾ inches described in AAR standard S-181. In other embodiments, the cushioning unit fits between front and rear stops of an "EOC-8" pocket, having a pocket length of about 48¾ inches described in AAR standard S-181. In other embodiments, the cushioning device may be adapted to fit other AAR standard or non-standard pocket dimensions depending on the application.

As used herein the term "E-Type" refers to a yoke connected to a coupler by a coupler key (also called a "draft key") inserted laterally and does not necessarily refer to a standard-dimension yoke. A yoke utilized with a selective cushioning unit according to the invention will typically be longer than a standard E-Type yoke used with a hydraulic unit, but the configuration would be recognizable as "E-Type" to a person having ordinary skill in the art and would be interoperable with railway car components configured for use with a conventional E-Type yoke. In some embodiments, the selective cushioning apparatus fits into a standard sill pocket for a hydraulic unit.

A cushioning unit according to one embodiment of the invention is depicted in the perspective view of FIG. 1, including a first stack 17 of elastomeric units positioned in an inside area of yoke 12 in front portion 120 forward of vertical wall 11 and behind coupler follower 13. In the embodiment shown, a second stack 14 of elastomeric units is positioned in rear portion 130 behind the first stack 17. In this arrangement, first stack 17 absorbs buff and draft loads on coupler 14, whereas second stack 14 absorbs buff loads only. The configuration and operation of these components is substantially the same as described in the aforesaid co-pending applications and issued patents of the inventors herein.

Figure 2:
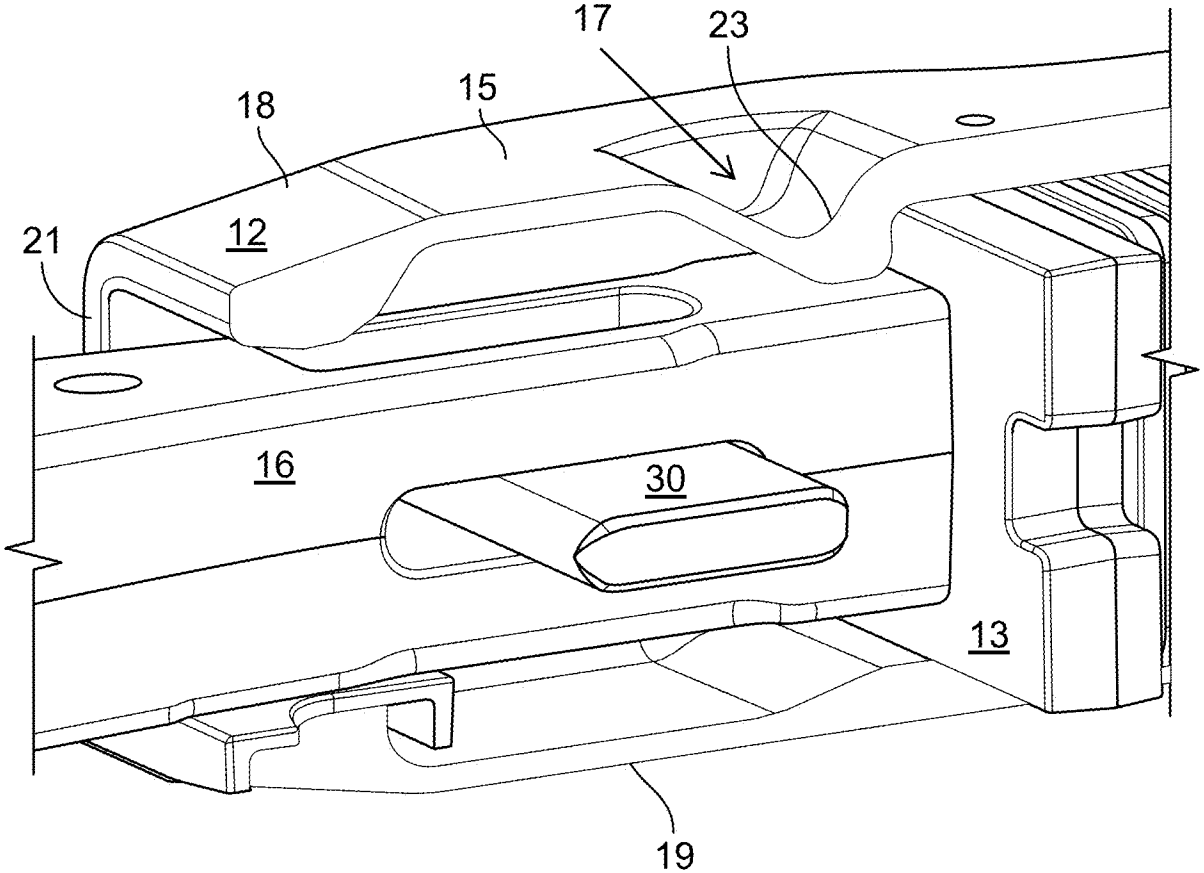
FIG. 2 is a cutaway view of an apparatus according to an embodiment of the invention showing the engagement of the yoke with a coupler.

In the cutaway detail view of FIG. 2, E-Type yoke 12 is adapted to receive coupler shank 16. Yoke 12 has a front (or "nose") end 18 opposite rear wall 11 (shown in FIG. 1), a top wall 15 and a bottom wall 19 opposite top wall 15, a first side wall 21 connecting top wall 15 and bottom wall 19, and a second side wall (not shown in the cutaway view) opposite first side wall 21. First and second side walls each have an aligned key slot toward the front end of the yoke adapted to receive the laterally inserted coupler key 30. Top wall 15 and bottom wall 19 each have an interior surface facing coupler shank 16 defining inside area of yoke 12.

Figure 3:
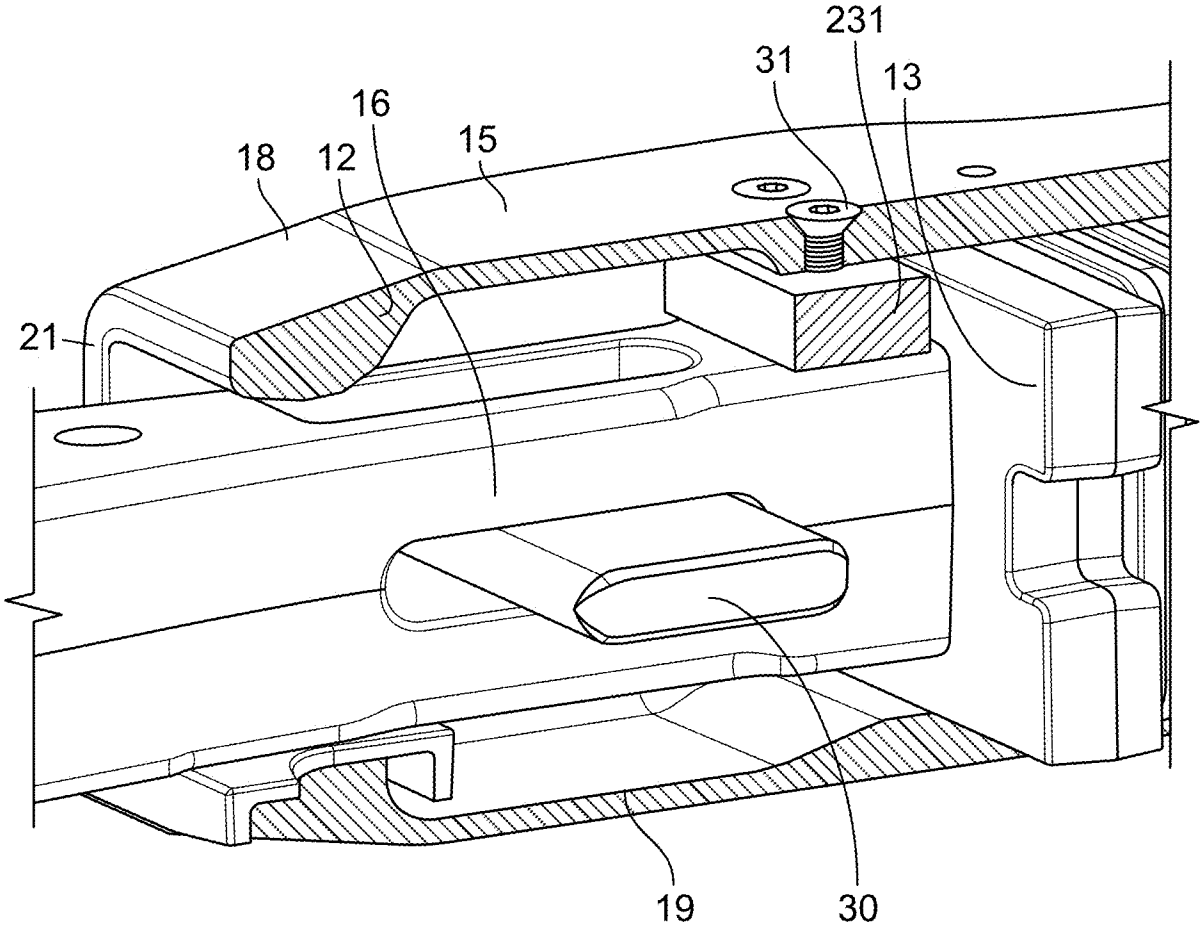
FIG. 3 is cutaway view according to another embodiment of the invention.

In the embodiment shown in FIG. 2, coupler support 23 protrudes from the interior surface of top wall 15 and retains coupler shank 16 when an end of the coupler extending from the railway car is deflected downward. In FIG. 2, coupler support 23 is formed integrally with the wall of the yoke (i.e., as one piece, for example, formed from an indentation 17 in top wall 15). In embodiments, support 23 is a formation on the inside of top wall 15 without forming an indentation 17on the outer surface of yoke 12. In embodiments, a wear plate 47with two flanges defining a u-shaped wear plate (shown in FIG. 4) may be provided on coupler support 23, attached with a frictional snap-on fit, or with a fastener. In another embodiment depicted in FIG. 3, at least one hole is provided in top wall 15 to receive fastener 31, so that coupler support 231 can be fastened to interior surface of top wall 15. In this way, coupler support 231 may be made removable and adjustable and existing yokes can be modified to include a coupler support by drilling holes and attaching a block to the interior surface of top wall 15.

In embodiments, one or more stacks 14 of elastomeric units may be provided behind the yoke to absorb buff loads on the coupler. As in the aforesaid patents and co-pending applications by the inventors herein, these "buff" stack(s) of elastomeric units may comprise a set of rigid metal plates, each metal plate having at least one elastomeric pad thereon, adapted so that each metal plate of the elastomeric units contacts an adjacent metal plate at full compression of the stack. Preferably, full compression of first stack 17 and second stack 14 permits buff travel in a range of about 6 to 18 inches. In embodiments, where the apparatus is adapted to fit into an EOC 7 pocket, at full compression of the first stack and the second stack, the apparatus permits buff travel in a range of about 7 to about 8 inches. In another embodiment, where the apparatus is adapted to fit into an EOC-8 pocket, a longer second stack is provided, which provides buff travel in a range of about 9 to about 10 inches. Thus, in embodiments, the selective cushioning apparatus is retrofit for a pocket designed for an EOC-7 or EOC-8 end of car arrangement, replacing a draft gear or hydraulic unit.

A first or "draft" stack of elastomeric units 32 may be provided in area 120 in front of tail wall 11 of yoke 12 behind coupler follower 13. Each elastomeric unit 32 comprises a metal plate and at least one elastomeric pad, and at full travel, metal-to-metal contact is made between adjacent metal plates to control the amount of travel and prevent over-compression of the elastomeric pads. Lateral guide 33 may be provided to assist in the alignment of elastomeric units 32 in yoke 12. In the embodiment shown, coupler follower 13 is also provided with a notch to avoid lateral guide 33.

Figure 4:
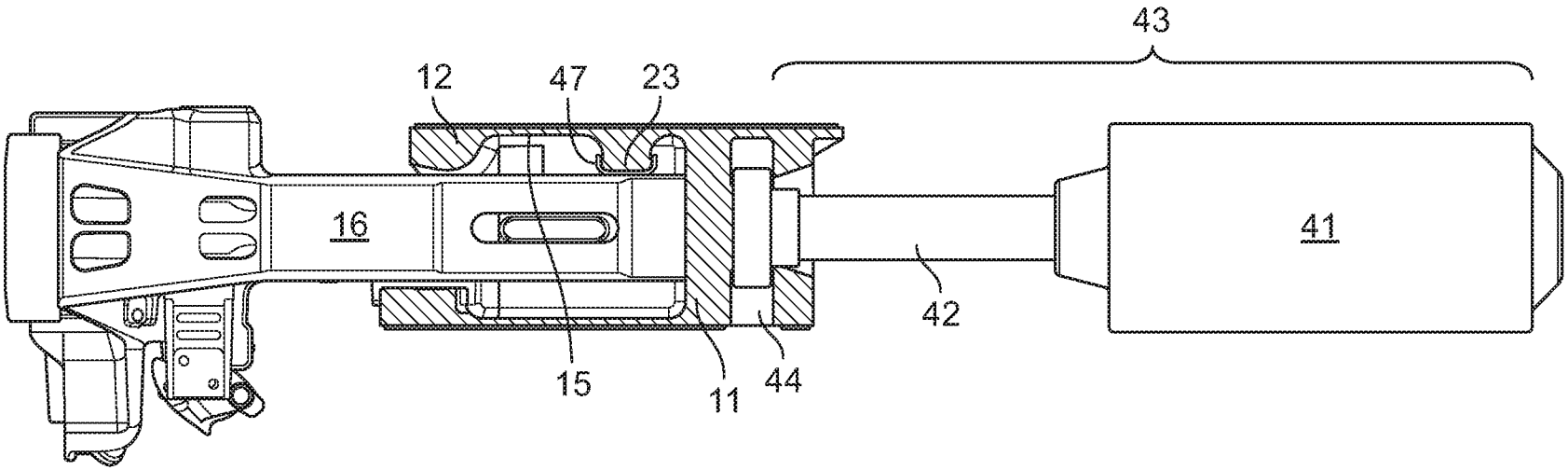
FIG. 4 is a cutaway view showing a coupler support incorporated into a hydraulic EOCC unit according to an embodiment of the invention.

FIG. 4 depicts an embodiment of the invention adapted for use with a hydraulic unit, wherein coupler 16 is received in the front end of yoke 12 and the butt end of coupler 16 abuts vertical rear wall 11 of yoke 12, compressing piston 42 of a hydraulic unit 43 as loads are applied to coupler 16. Piston 42 is received in a recess 44 behind vertical rear wall 11 of yoke 12 and compresses fluid in cylinder 41 to dissipate energy of loads applied to coupler 16. In the embodiment shown, coupler support 23 is an integral feature formed on the inner surface of top wall 15 of yoke 12. A friction wear plate 47 may be provided as part of coupler support 23 and may be removable, i.e. snapped on, or attached with fasteners. Conventional geometry provides support for coupler 16 at the bottom lip at the opening of the yoke. The entire apparatus may be sized to fit in a standard EOC 8 pocket.

Figure 5:
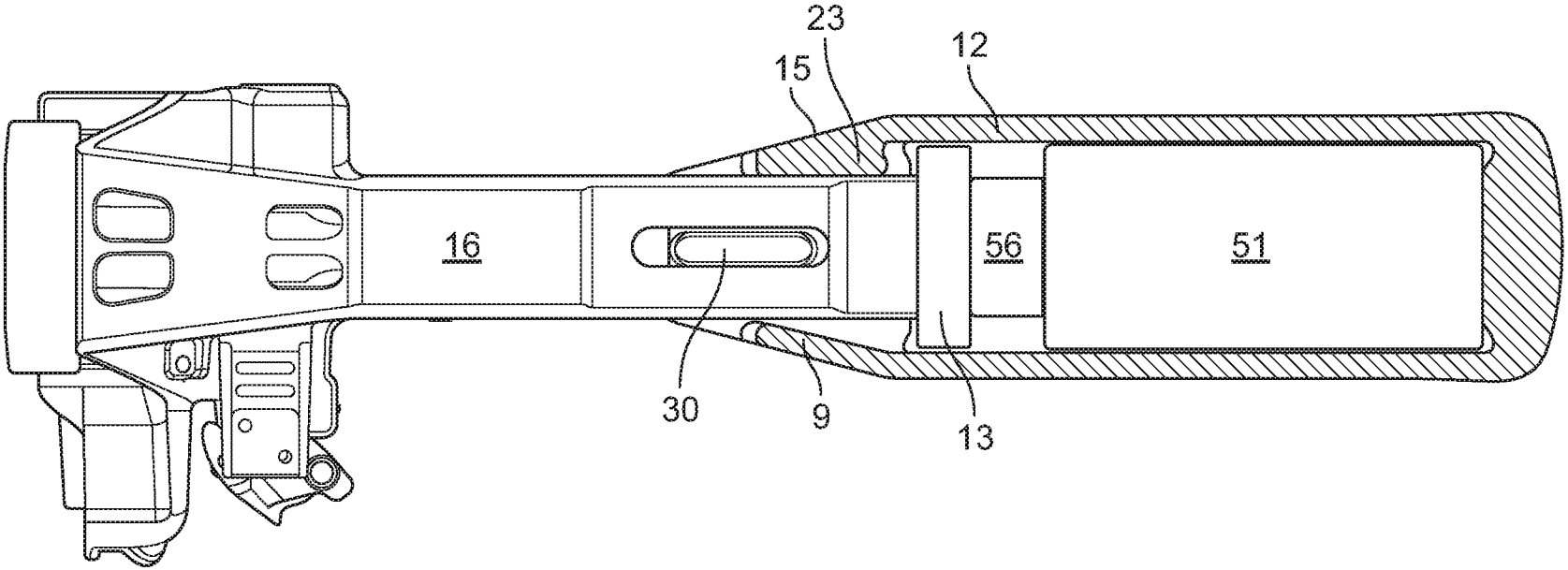
FIG. 5 depicts a standard draft gear with an E-Type yoke having a coupler support feature according to an embodiment of the invention.

FIG. 5 depicts a yoke-mounted coupler support in combination with a draft gear which may be configured to fit an EOC 7 pocket. Coupler shank 16 is received in the front end of the yoke abutting a coupler follower 13 positioned inside yoke 12 adapted to move responsive to loads on coupler 16. A conventional design for yoke 12 includes a tapered nose section, with walls 15, 19 tapering toward coupler 16. Coupler support 23 extending from top wall 15 into an interior space of the yoke at the front end is adapted to contact coupler shank and reduce downward deflection of the coupler. Frictional draft gear 51 is received in the interior space in the yoke and may comprise a housing, an elastic element received in the housing and a piston or friction clutch 56 compressing the elastic element in response to buff and draft loads on the coupler.

Figure 6A:
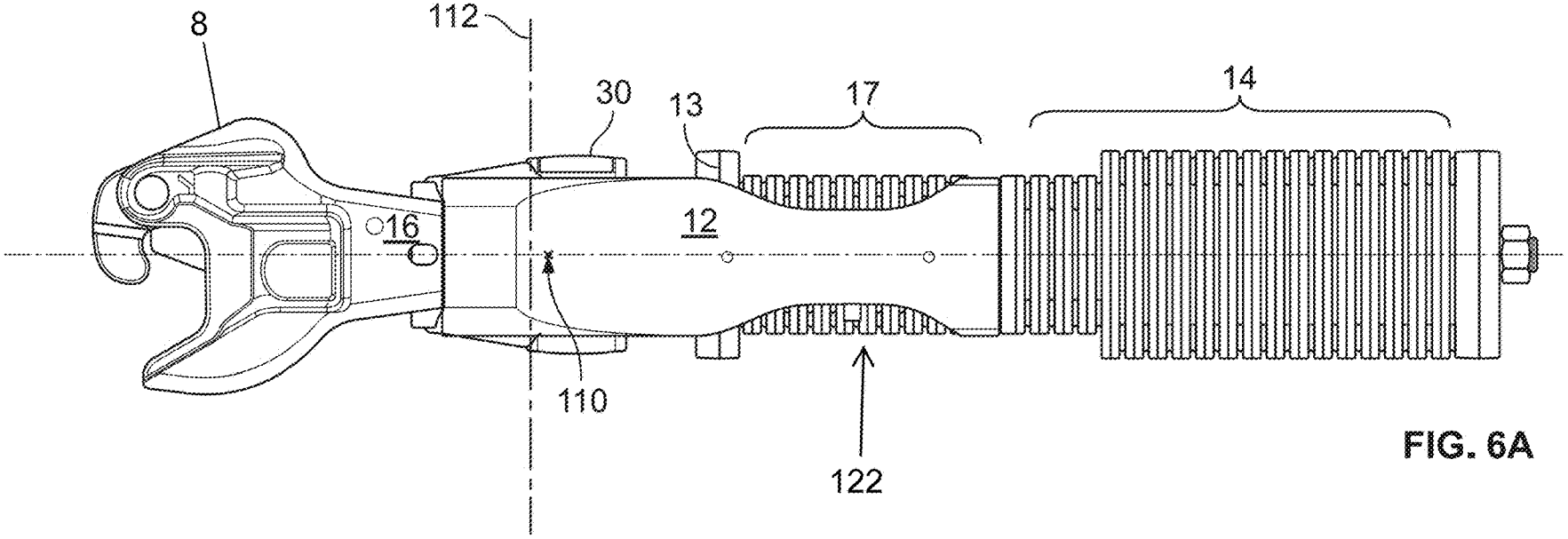
FIG. 6A and FIG. 6B depict locations of the center of gravity on a selective cushioning unit apparatus and a hydraulic EOCC unit, respectively.
Figure 6B:
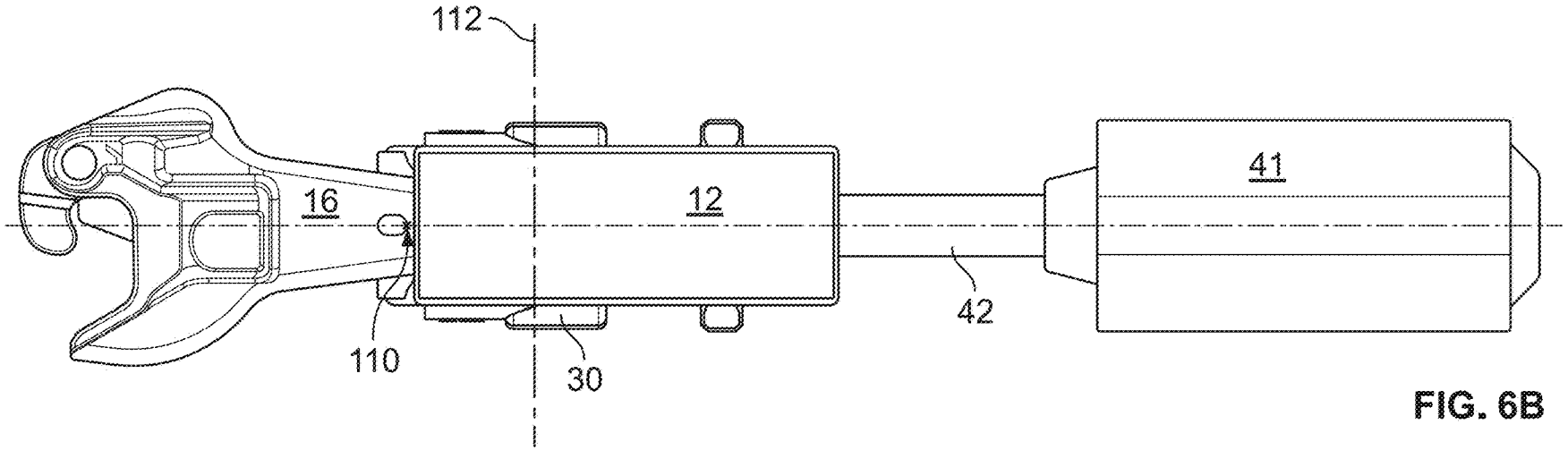

FIG. 6A depicts a coupler 16 and yoke 12 configured for a selective cushioning unit system, comprising a stack of elastomeric units 17 in an inside area of yoke 12, and one or more second stacks 14 behind yoke 12. The position of the center of gravity 110 of the combined coupler and yoke in this embodiment is moved inboard of the end of the car (represented by the dashed line 112) by extending the tail of the yoke in a rearward direction. This positioning of the center of gravity 110 inboard, compared with a conventional floating yoke depicted in FIG. 6B, is in an amount sufficient to place the center of gravity of the yoke inboard of the end of the car to prevent excess vertical forces on the draft key and to prevent the coupler from drooping. Center of gravity 110' in FIG. 6B is approximately 8 inches outboard of the end of the car, which places more torque on the draft key 30.

The description of the foregoing preferred embodiments is not to be considered as limiting the invention, which is defined according to the appended claims. The person of ordinary skill in the art, relying on the foregoing disclosure, may practice variants of the embodiments described without departing from the scope of the invention claimed. A feature or dependent claim limitation described in connection with one embodiment or independent claim may be adapted for use with another embodiment or independent claim, without departing from the scope of the invention.

What is claimed is:

1. A yoke for a railway car, the yoke comprising:

an open front end configured to receive a coupler shank therethrough;

a rear wall opposite the open front end;

two walls connecting the open front end with the rear wall;

a coupler support extending from an interior surface of one wall from the two walls into an interior space of the yoke between the open front end and the rear wall; and a wear plate attached to the coupler support, the wear plate having two flanges defining a u-shape of the wear plate, the two flanges being spaced from each other, on the coupler support, in a longitudinal direction of the yoke, a surface of the wear plate positioned to contact a surface of a coupler shank.

2. The yoke of claim 1, further comprising two additional walls, each additional wall from the two additional walls connected with each wall from the two walls.

3. The yoke of claim 2, further comprising a key slot through a thickness of the each additional wall.

4. The yoke of claim 1, further comprising two side walls, each side wall from the two side walls connected with each wall from the two walls.

5. The yoke of claim 1, wherein the coupler support comprises:

a block; and holes through a thickness of one wall to attach, with fasteners, the block to the interior surface of the one wall.

6. The yoke of claim 1, wherein the coupler support comprises:

a hole through a thickness of the one wall; and a block fastened to the interior surface of the one wall with a fastener passed through the hole.

7. The yoke of claim 1, wherein the coupler support comprises:

a protrusion integrally formed with the yoke on the interior surface of the one wall.

8. The yoke of claim 1, further comprising a lateral guide.

9. The yoke of claim 1, wherein the coupler support being formed integrally with the one wall and defining an indentation in an exterior surface of the one wall.

10. The yoke of claim 1, wherein the wear plate being attached to the coupler support with a friction snap fit.

11. The yoke of claim 1, wherein the wear plate being attached to the coupler support with a fastener.

12. An end-of-car cushioning apparatus, comprising:

a yoke, the yoke comprises an open front end configured to receive a coupler shank therethrough, a rear wall opposite the open front end, and two walls connecting the open front end with the rear wall; and a coupler support, the coupler support comprises a protrusion extending from an interior surface of one wall from the two walls into an interior space of the yoke between the open front end and the rear wall, and a wear plate being attached to the protrusion with a frictional snap fit, the wear plate configured to contact the coupler shank, the wear plate having two flanges defining a u-shape of the wear plate, the two flanges being spaced from each other, on the coupler support, in a longitudinal direction.

13. The end-of-car cushioning apparatus of claim 12, further comprising:

a coupler-receiving member disposed within the interior space;

a first stack of elastomeric units positioned between the coupler-receiving member and the rear wall of the yoke; and a second stack of elastomeric units positioned external to the rear wall of the yoke.

14. The end-of-car cushioning apparatus of claim 13, wherein each elastomeric unit comprises a metal plate and an elastomeric pad.

15. The end-of-car cushioning apparatus of claim 13, wherein the first stack of elastomeric units configured to compress in a response to buff and draft loads on a coupler of a railway car.

16. The end-of-car cushioning apparatus of claim 13, wherein the first stack of elastomeric units configured to absorb buff loads on a coupler of a railway car.

17. The end-of-car cushioning apparatus of claim 12, further comprising a frictional draft gear received in the interior space, the frictional draft gear comprising a housing, an elastic element received in the housing and a piston or a friction clutch compressing the elastic element in a response to buff and draft loadson a coupler of a railway car.

18. The end-of-car cushioning apparatus of claim 12, further comprising a hydraulic unit positioned external to the rear wall of the yoke, the hydraulic unit having a piston received in a recess of the yoke external to the rear wall of the yoke, and a cylinder filled with a fluid and receiving the piston, wherein the fluid is adapted to dissipate forces during a movement of the piston in the cylinder in a response to loads on a coupler of a railway car.

19. The yoke of claim 12, wherein the coupler support and the wear plate configured to at least reduce a downward deflection of a coupler.

20. The end-of-car cushioning apparatus of claim 12, further comprising a coupler-receiving member disposed within the interior space and adjacent the coupler support.

21. The end-of-car cushioning apparatus of claim 20, further comprising a stack of elastomeric units positioned between the coupler-receiving member and the rear wall of the yoke.

22. The end-of-car cushioning apparatus of claim 12, further comprising a recess adjacent an external surface of the rear wall, the recess configured to receive a piston of a hydraulic cushioning unit.

23. An end-of-car cushioning apparatus for a railway car, comprising:

a coupler with a coupler shank;

a yoke, the yoke comprises an open front end configured to receive the coupler shank therethrough, a rear wall opposite the open front end, and two walls connecting the open front end with the rear wall; and a coupler support, the coupler support comprises a protrusion extending from an interior surface of one wall from the two walls into an interior space of the yoke between the open front end and the rear wall;

a center of gravity of the yoke and the coupler disposed between the open front end and the rear wall and inboard of an end of the railway car.

24. A yoke for a railway car, the yoke comprising:

an open front end configured to receive a coupler shank therethrough;

a rear wall opposite the open front end;

two walls connecting the open front end with the rear wall; and a coupler support extending from an interior surface of one wall from the two walls into an interior space of the yoke between the open front end and the rear wall, the coupler support being formed integrally with the one wall and defining an indentation in an exterior surface of the one wall.

25. A yoke for a railway car, the yoke comprising:

an open front end configured to receive a coupler shank therethrough;

a rear wall opposite the open front end;

two walls connecting the open front end with the rear wall; and a coupler support extending from an interior surface of one wall from the two walls into an interior space of the yoke between the open front end and the rear wall, the coupler support including:

a block, and holes through a thickness of one wall to attach, with fasteners, the block to the interior surface of the one wall.

26. A yoke for a railway car, the yoke comprising:

an open front end configured to receive a coupler shank therethrough;

a rear wall opposite the open front end;

two walls connecting the open front end with the rear wall; and a coupler support extending from an interior surface of one wall from the two walls into an interior space of the yoke between the open front end and the rear wall, the coupler support including:

a hole through a thickness of the one wall, and a block fastened to the interior surface of the one wall with a fastener passed through the hole, the block configured to contact a coupler shank.

* * * * *